United States Patent [19]

Barrett

[11] 4,101,184

[45] Jul. 18, 1978

[54] TELEPHONE BOOK HOLDER

[76] Inventor: Warren E. Barrett, 1198 Topeka St., Pasadena, Calif. 91104

[21] Appl. No.: 714,187

[22] Filed: Aug. 13, 1976

[51] Int. Cl.[2] ..... A47B 41/06

[52] U.S. Cl. ..... 312/233; 312/245; 312/328; 248/447

[58] Field of Search ..... 312/233, 328, 245; 248/447, 240.1

[56] References Cited

U.S. PATENT DOCUMENTS

| | | | |
|---|---|---|---|
| 173,047 | 2/1876 | Noble | 312/233 |
| 194,970 | 9/1877 | Morgan | 312/245 |
| 533,232 | 1/1895 | Phillips | 312/233 |
| 1,527,880 | 2/1925 | Kositzky | 248/447 |
| 1,712,704 | 5/1929 | Kiser | 248/240.1 |
| 1,753,423 | 4/1930 | Kroschel | 248/240.1 |
| 2,223,958 | 12/1940 | Laursen | 248/240.1 |
| 2,299,409 | 10/1942 | Rathburn | 312/328 |
| 2,770,913 | 11/1956 | Haskin | 248/447 |
| 2,779,649 | 1/1957 | Neilson | 312/245 |

FOREIGN PATENT DOCUMENTS

| | | | |
|---|---|---|---|
| 1,426,686 | 7/1966 | France | 312/233 |
| 117,636 | 5/1919 | United Kingdom | 248/240.1 |

*Primary Examiner*—Robert L. Wolfe
*Assistant Examiner*—Victor N. Sakran
*Attorney, Agent, or Firm*—B. Deon Criddle

[57] ABSTRACT

A holder for telephone directories and the like that is adapted to be mounted on a wall and that will store the directory in a concealed manner, but that will allow it to be readily displayed in usable fashion. A central carrier member for a directory slides up and down and pivots with respect to a carrier support member to store and display the directories and the like.

3 Claims, 4 Drawing Figures

TELEPHONE BOOK HOLDER

BRIEF DESCRIPTION OF THE INVENTION

1. Field of the Invention

This invention relates to book holders, and the like, and is particularly concerned with the storage and display of telephone directories and the like.

2. Prior Art

It has long been recognized that there is a need for a holder for telephone directories and the like that will store the directory in an unobtrusive manner when the directory is not in use, but that will allow the directory to be fully displayed for use.

Telephone directories, are frequently subjected to extensive use and, because they are usually made of very inexpensive materials, they are subject to rapid deterioration as a result of such use. Often, they become tattered and frayed and quite unattractive, long before they are due for replacement. This is true of directories used in the home and is even more true of those directories placed in commercial establishments or made available to public use. Even when the directories are in a new condition, they are generally not very attractive, and most people do not like to have them lying around in public view. Consequently, they are frequently placed in a drawer or are hidden in some other fashion.

It is often inconvenient, also, to have to hold a telephone directory while it is being used. This is particularly true if the directory is for a heavily populated area and is both bulky and heavy.

Many devices have been proposed in the past for supporting books as they are used, and some of these devices are particularly adapted to support telephone directories and the like. In addition, many of these prior art devices have included means for positioning the book in a unobtrusive fashion, when it is not being used. Such book holders are shown, for example, in U.S. Pat. Nos. 173,047, 1,334,020, 1,454,197, 1,980,650, and 2,638,398. Some of these prior art holders require mounting plates to allow them to be secured to a wall and pivoted hinged covers that will facilitate pivoting a book into the cover and swing of the cover into a flat position against the wall. In addition, some means of clamping the book to the assembly is required. Some of the other listed prior art patents merely swing the book from a flat position against the wall to a display position, but require means for clamping the book to the carrier and stop means to limit the pivoted movement of the carrier and book carried thereby. In addition, the prior art holders do not provide a pleasing esthetic appearance and, because of their structural arrangement are unduly costly to produce.

SUMMARY OF THE INVENTION

The present invention provides a holder for telephone directories and the like that can be inexpensively produced, that is esthetically attractive, that requires a minimum amount of space, that will hold a directory or the like, flat against the wall, that will fully cover the directory or the like in a stored position, and that is easily used to display the directory.

Principal objects of the present invention are to provide a holder for telephone directories and the like that is inexpensive, attractive, and easy to use.

Principal features of the invention include a wall mounted backing plate; a pair of spaced apart side panels projecting from the backing plate and having opposed, elongate slots therein; a carrier support member extending between the side panels, with the top of the carrier support member being intermediate the length of elongate slots; a carrier member having a top plate, a bottom plate, and a facing panel interconnecting the top and bottom plates; and pivot pins projecting from the carrier member and into the elongate slots.

Additional objects and features of the invention will be apparent from the following detailed description and drawing, disclosing what is presently contemplated as being the best mode of the invention.

THE DRAWING

In the drawing:

FIG. 1 is a perspective view of the telephone directory holder of the present invention, with the carrier member shown in it's storage position;

FIG. 2, a similar view with the carrier member shown in it's display position;

FIG. 3, a vertical section, taken on the line 3—3 of FIG. 2; and

FIG. 4, a side elevation view of the holder as shown in FIG. 2, but with the alternate swinging position of the carrier member shown by dotted lines.

DETAILED DESCRIPTION

Figure 1:
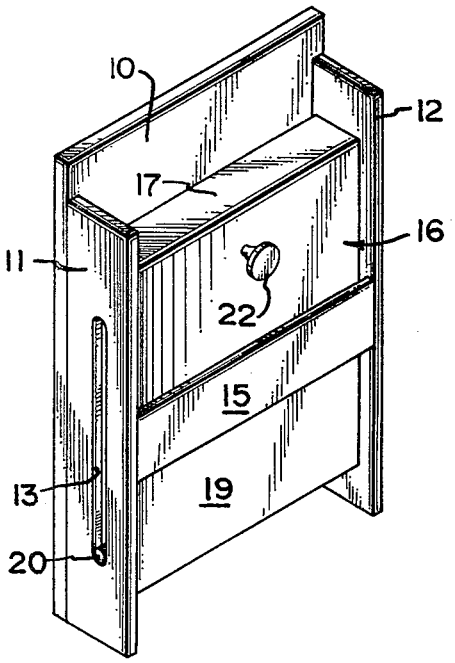

Referring now to the drawing:

In the illustrated preferred embodiment of the invention, the telephone directory holder includes a backing plate 10 that is adapted to be mounted to a wall by screws, not shown, or adhesive, or the like. The backing plate is flat, and of generally rectangular configuration, and has a pair of spaced apart side panels 11 and 12 projecting from opposite sides of one face of the backing plate. The side panels 11 and 12, respectively include opposed, vertically extending, elongate slots 13 and 14. A carrier support member 15 is spaced from the backing plate 10 and interconnects the side panels 11 and 12.

A carrier member, shown generally at 16, includes a top plate 17, a bottom plate 18, and a facing panel 19. The facing panel 19 is dimensioned to fit between the side panels 11 and 12 and against the carrier support member 15. The top plate 17 and bottom plate 18 project from opposite ends of the facing panel, and when the facing panel is against carrier support member 15 the top and bottom plates will fit between the side panels 11 and 12 and will extend closely adjacent to the backing plate 10. A pair of pins 20 and 21 extend outwardly from opposite ends of the bottom plate 18 and into the elongate slots 13 and 14.

A knob 22 is fixed to the facing panel 19 adjacent the top plate 17, to facilitate movement of the carrier.

Figure 3:
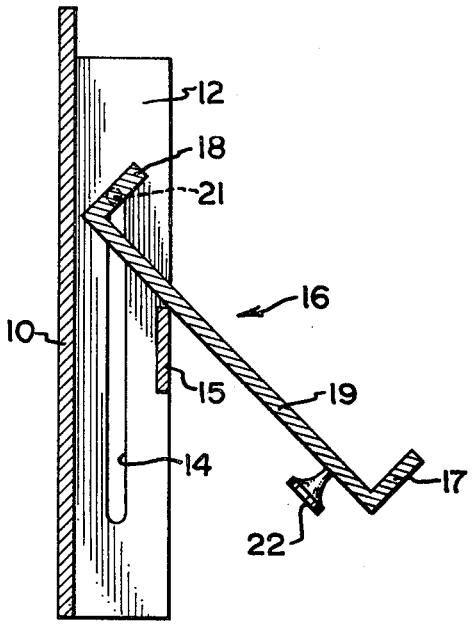
Figure 2:
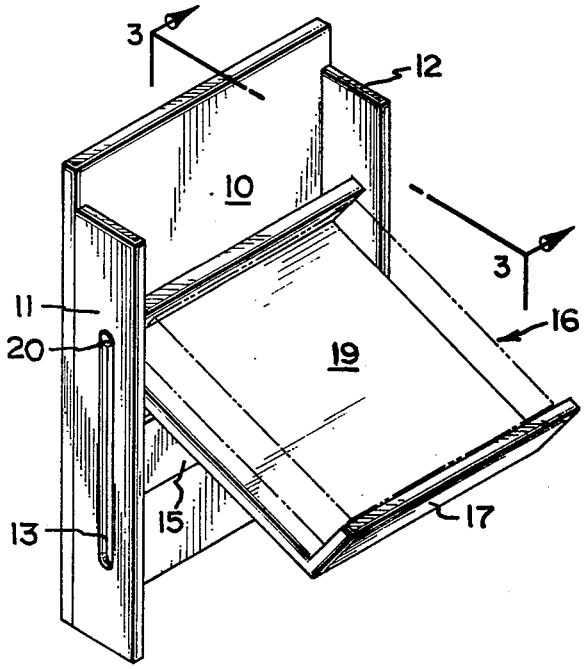
Figure 4:
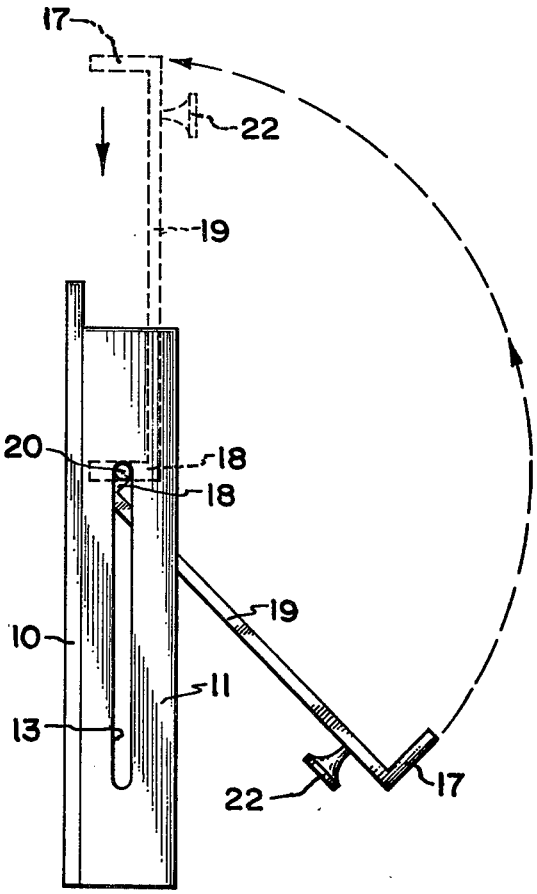

In use, the carrier member 16 is moved to the position shown in FIGS. 2–4, and a telephone directory, or the like, is placed thereon, with the top of the directory adjacent to the bottom plate 18. With the directory so positioned, it is a simple matter to turn the pages thereof and to make use of the directory, while it is supported by the carrier member. When the directory is no longer in use, the carrier member is moved to the storage position shown in FIG. 1, by pivoting the carrier member about the pins 20 and 21 until it is moved to the dotted line position shown in FIG. 4, extending upwardly from the side panels. Thereafter the carrier member is allowed to slide downwardly between the side panels, until the pins 20 and 21 engage the bottoms of the elongate slots 13 and 14. So positioned, the directory, or the like, carried by the carrier member, is fully hidden from view and is positioned flat against the backing plate 10, which is preferably mounted to a wall. A reverse procedure is followed when it is desired to change the directory from the storage position shown in FIG. 1 to the display position shown in FIGS. 2–4. In moving the directory from the storage position to the display position, the handle 22 is grasped, to raise the carrier member and a directory, or the like, carried thereby until the carrier member will pivot around the pins 20 and 21 and over the carrier support member 15. So positioned, the carrier member supports the directory, such that the directory can be easily used.

Although a preferred form of my invention has been hereindisclosed, it is to be understood that the present disclosure is made by way of example and that variations are possible without departing from the scope of the hereinafter claimed subject matter, which subject matter I regard as my invention.

I claim:

1. A holder for telephone book directories and the like comprising a backing plate adapted to be mounted on a wall;

a pair of spaced apart side panels extending from one face of the backing plate;

a vertical extending elongate slot in each of the said panels, said slots being in opposed relationship;

a carrier support member spaced from the backing plate and interconnecting the side panels; and a carrier member, adapted to hold a telephone directory, or the like, said carrier member fitting between the side panels and between the backing plate and carrier support member and having pins projecting from a lower end thereof and into the elongate slots of the side panels, a facing panel extending between the side panels and having a face adapted to extend sufficiently close to the carrier support member that said corner support member will act as a pivot for the facing panel, and top and bottom plates respectively extending from the facing panel and between the side panels, said top and bottom plates extending closely adjacent to the backing plate whereby said top plate will hold the directory on the facing panel when the directory is being displayed and the bottom plate will hold the directory on the facing panel when the directory is being stored.

2. A holder as in claim 1, further including handle means projecting from the facing panel at an upper end thereof near the top plate.

3. A holder as in claim 2, wherein the pins project from the bottom plate into the side panels.

* * * * *